US005594382A

United States Patent [19]

Kato et al.

[11] Patent Number: 5,594,382

[45] Date of Patent: Jan. 14, 1997

[54] CONSTANT VOLTAGE CIRCUIT

[75] Inventors: Susumu Kato; Moriaki Mizuno; Kazumi Ogawa; Kazuyuki Nonaka, all of Kasugai, Japan

[73] Assignees: Fujitsu Ltd., Kanagawa; Fujitsu VLSI Limited, Aichi, both of Japan

[21] Appl. No.: 407,248

[22] Filed: Mar. 20, 1995

Related U.S. Application Data

[63] Continuation of Ser. No. 138,084, Oct. 20, 1993, abandoned.

[30] Foreign Application Priority Data

Oct. 20, 1992 [JP] Japan ..... 4-282071

[51] Int. Cl.[6] ..... G05F 1/10; G05F 3/02

[52] U.S. Cl. ..... 327/541; 327/543; 327/546; 327/539; 323/315

[58] Field of Search ..... 307/296.1, 296.4, 307/296.5, 296.6, 296.8, 571; 323/313, 315; 327/538, 539, 540, 541, 542, 543, 544, 545, 546, 432

[56] References Cited

U.S. PATENT DOCUMENTS

| | | | |
|---|---|---|---|
| 3,996,482 | 12/1976 | Lockwood | 307/296.6 |
| 4,698,529 | 10/1987 | Asami | 307/296.5 |
| 4,716,305 | 12/1987 | Sakuragi et al. | 307/296.6 |
| 5,159,516 | 10/1992 | Fujihira | 323/315 |
| 5,189,316 | 2/1993 | Murakami et al. | 307/296.6 |
| 5,218,238 | 6/1993 | Honaka et al. | 307/296.6 |
| 5,300,837 | 4/1994 | Fischer | 307/296.6 |
| 5,309,083 | 5/1994 | Pierret et al. | 327/540 |
| 5,381,083 | 1/1995 | Inamori et al. | 327/538 |

*Primary Examiner*—Timothy P. Callahan
*Assistant Examiner*—My-Trang Nu Ton
*Attorney, Agent, or Firm*—Staas & Halsey

[57] ABSTRACT

A constant voltage circuit adapted for connection between high voltage power source and low voltage power source terminals respectively to output a constant voltage signal from an output terminal in response to a control signal inputted to an input terminal. The circuit has a resistor circuit including a MOS transistor for connection to the high voltage power source and activated in response to the control signal. A current mirror section is connected between the resistor circuit and the low voltage power source terminal to generate an output voltage to be outputted from the output terminal. A feedback section is connected between the resistor circuit and the low voltage power source terminal to control the current mirror section to keep the output voltage constant by detecting deviation of the output voltage.

7 Claims, 6 Drawing Sheets

CONSTANT VOLTAGE CIRCUIT

This application is a continuation, of application Ser. No. 08/138,084 filed Oct. 20, 1993, now abandoned.

BACKGROUND OF THE INVENTION

1. Field of the Invention

The present invention relates to a constant voltage circuit, and, more particularly, to a constant voltage circuit formed in a semiconductor integrated circuit, such as LSI (Large-Scale Integration).

2. Description of the Related Art

LSI includes a variety of circuits, such as for instance various logic circuits. LSI also includes constant voltage circuits for supplying constant voltages to these logic circuits. In accordance with the recent trend to reduce consumed power of LSI, there is a demand for lower power consumption in constant voltage circuit such as for example, intermittent operation of the constant voltage circuits to reduce consumed power.

Conventionally, a bipolar LSI circuit may have various constant voltage circuits incorporated therein to supply constant voltages to logic circuits, etc. One of the constant voltage circuits is a band gap bias circuit shown in FIG. 1. The band gap bias circuit is a circuit which outputs a voltage signal corresponding to the energy difference between the conduction band and the valence band in silicon (Si).

The bias circuit 20 comprises resistors R20 through R27 and NPN type transistors Q11 through Q15. The base of transistor Q15 is connected to a node N11 between resistors R20 and R27, with an output terminal 21 connected between an emitter of the transistor Q15 and a resistor R23. A PNP power saving transistor Q10 is connected between the node N11 and a ground GND. A control signal PS is supplied to the base of the transistor Q10.

When the control signal PS of a high (H) level is inputted to the transistor Q10, this transistor Q10 is turned off. As a result, a current flows into the bias circuit 20 through the resistor R20. The band gap bias circuit then becomes operable and outputs a constant voltage VCS, less source-voltage dependent and less temperature dependent, from the output terminal 21.

When the control signal PS of a low (L) level is inputted to the transistor Q10 if it is not necessary to output the voltage VCS, this transistor Q10 is turned on. A current then flows into the ground through the node N11 and the transistor Q10. consequently, the potential at the node N11 becomes the same as that of the ground GND, and the band gap bias circuit stops functioning, thus reducing the consumed power.

As the band gap bias circuit stops functioning, the consumed power in the bias circuit 20 itself is reduced, but the transistor Q10 is kept on even in this state, causing a slight amount of current to flow through a resistor R20 and the transistor Q10. Accordingly, slight power consumption is experienced even when the band gap bias circuit 20 stops functioning.

SUMMARY OF THE INVENTION

The present invention was developed with a view to solving the above problem, and it is therefore an object of the present invention to provide a constant voltage circuit which shuts down completely, i.e. involves, no power consumption while the circuit stops functioning, thus reducing consumed power with respect to the entire operation of the circuit.

To achieve the above object, a constant voltage circuit is connected between a high voltage power source and a low voltage power source to output an constant voltage from an output terminal in response to a control signal inputted to an input terminal. The circuit has a resistor circuit including a MOS transistor connected to the high voltage power source and activated in response to the control signal. A current mirror section is connected between the resistor circuit and the low voltage power source to generate an output voltage to be output from the output terminal. A feedback section is connected between the resistor circuit and the low voltage power source to control the current mirror section to keep the output voltage constant by detecting deviation of the output voltage.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
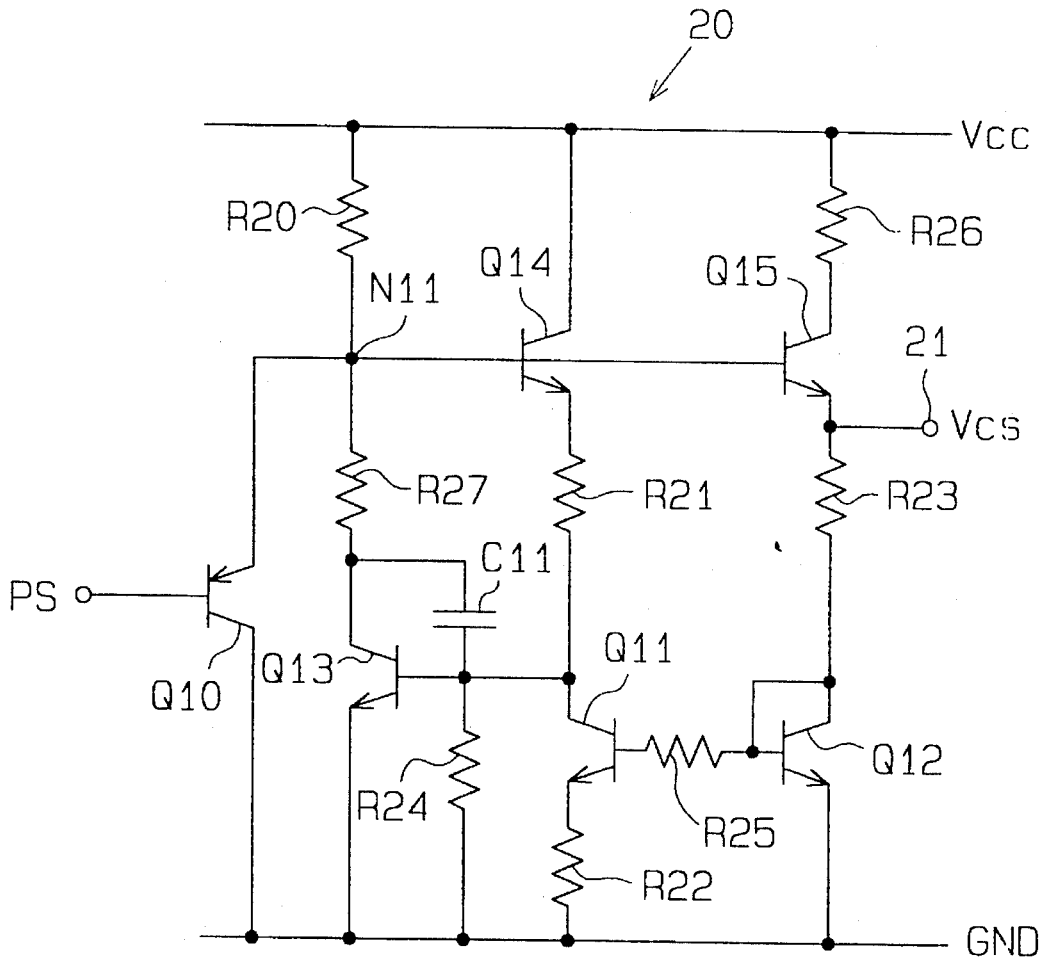
FIG. 1 (Prior Art)
FIG. 1 is a circuit diagram showing a conventional band gap bias circuit.

One preferred embodiment of the present invention as applied to a band gap bias circuit formed on a semiconductor substrate will now be described referring to the drawings.

Figure 2:
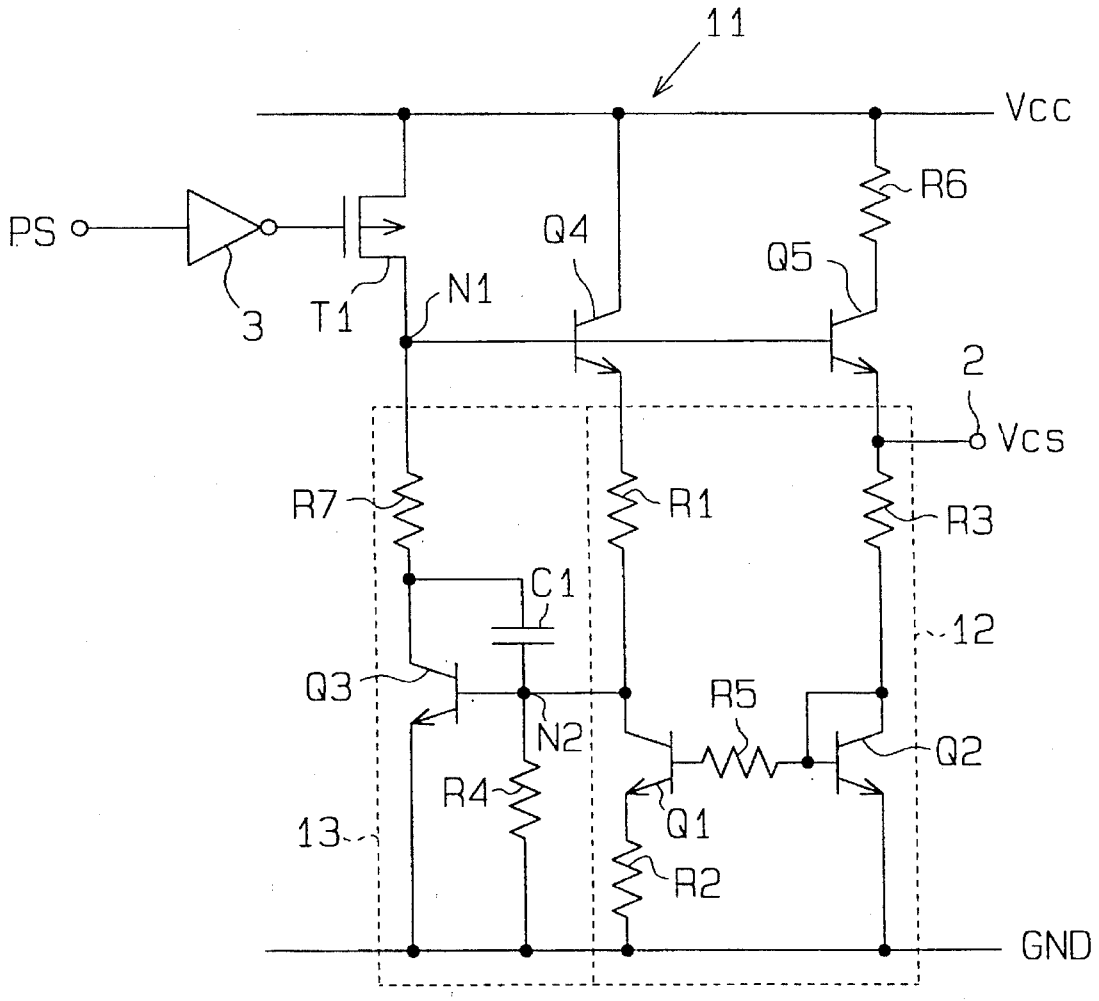
FIG. 2 is a circuit diagram showing a band gap bias circuit of an embodiment according to the present invention.

FIG. 2 shows the band gap bias circuit 11 of the embodiment. The band gap bias circuit 11 is a circuit for supplying a reference voltage to various analog circuits. The bias circuit 11 comprises a current mirror section 12, a PMOS transistor T1 as a resistor circuit and a feedback section 13.

The current mirror section 12 includes resistors R1, R2, R3 and R5 and first and second NPN type transistors Q1 and Q2. The bases of the first and second transistors Q1 and Q2 are connected together via the resistor R5 which serves to prevent oscillation of a output voltage VCS from the current mirror section 12. The resistor R3 is connected between a collector of the second transistor Q2 and an output terminal 2. An emitter of the second transistor Q2 is connected to the ground GND.

An emitter size (area) of the first transistor Q1 is set to several times (three times in this embodiment) that of the second transistor Q2. The resistor R1 is connected to the collector of the transistor Q1. A first end of the resistor R2 is connected to the emitter of the first transistor Q1. A second end of the resistor R2 is connected to the ground (low potential source) GND. This resistor R2 serves to absorb a change in current in the transistor Q2 due to a variation in the potential at the output terminal 2 to always keep the collector current of the transistor Q1 constant.

A voltage-dropping NPN type transistor Q4 is connected between a high potential source VCC and the resistor R1. A resistor R6 and a voltage-dropping NPN type transistor Q5 are connected in series between the high potential source VCC and the resistor R3.

The P type MOS transistor T1 has its source connected to the high potential source VCC and its drain connected to the bases of the transistors Q4 and Q5. A gate of the PMOS transistor T1 is supplied with a control signal PS via an inverter 3. When the control signal PS is at an H level, the MOS transistor T1 is turned on and serves as a resistor, supplying a bias voltage (i.e. a voltage between the node N1 and the ground GND) to the transistors Q4 and Q5. When the control signal PS is at an L level, the MOS transistor T1 is turned off to stop supplying the bias voltage to the transistors Q4 and Q5, rendering the band gap bias circuit inactive.

The feedback section 13 includes resistors R4 and R7, a capacitor C1 and a third NPN type transistor Q3. This transistor Q3 has its base connected to the collector of the first transistor Q1 and its collector connected via the resistor R7 to the drain of the MOS transistor T1. A first end of the resistor R4 is connected to the base of the transistor Q3 via a node N2. A second end of the resistor R4 is connected to the ground GND. The capacitor Cl, which serves to prevent oscillation of the output voltage VCS, is connected between the collector and the base of the third transistor Q3.

The operation according to the teachings of the invention of the band gap bias circuit 11 will be explained below.

When the H-level control signal PS is inputted to the band gap bias circuit, the output of the invertor 3 becomes an L level, turning on the MOS transistor T1. This renders the band gap bias circuit operable. With the band gap bias circuit in an operable state, the MOS transistor T1 serves as a resistor. The bias voltage at a node N1 is determined by a current which flows through the MOS transistor T1, resistor R7 and third transistor Q3. The bias voltage is supplied to the bases of the transistors Q4 and Q5. The transistor Q5 is turned on and its emitter voltage becomes lower than the bias voltage by the base-emitter voltage of the transistor Q5. The emitter voltage of the transistor Q5 is output as the voltage VCS from the output terminal 2.

When the bias voltage at the node N1 rises based on the increase of the voltage from the power source VCC influenced by peripheral circuits, in the above situation, the collector current of the transistor Q4 increases. However, since the collector current of the transistor Q1 keeps substantially constant, the current flowing through the resistor R4 increases. The potential drop by the resistor R4 therefor increases, and the potential at the node N2 rises. In accordance with this potential rise, the third transistor Q3 draws the current via the MOS transistor T1 and the resistor R7. As a result, the potential drop at the MOS transistor T1 increases, lowering the potential at the node N1 by the amount of the rise of the bias voltage. Therefore, the bias voltage at the node N1 kept constant. So therefore is the voltage VCS is kept constant.

When the bias voltage at the node N1 drops based on the potential drop by the power source VCC, on the other hand, the collector current of the transistor Q4 decreases. Since the collector current of the transistor Q1 is kept substantially constant, the current flowing through the resistor R4 decreases. Therefore, the potential drop at the resistor R4 decreases, and the potential at the node N2 falls. In accordance with this potential drop, the amount of the current drawn to the third transistor Q3 is suppressed to decrease the potential drop at the MOS transistor T1 and to increase the potential at the node N1 by the amount of the aforementioned bias voltage drop. Therefore, the bias voltage at the node N1 is kept constant and the voltage VCS is also kept constant.

The L-level control signal PS is inputted to the band gap bias circuit when it is not necessary to output the voltage VCS, causing the output of the inverter 3 to become an H level, turning off the MOS transistor T1. Accordingly, the bias voltage is not supplied to the bias circuit 11, turning off the transistors Q1 through Q5. This sets the band gap bias circuit inactive. As a result, the voltage VCS is not output, and neither is power consumed by the bias circuit 11.

According to this embodiment, as described above, the resistor circuit, which supplies the bias voltage to the transistors Q4, Q5 in the band gap bias circuit 11, is constituted of the P type MOS transistor T1. In the power saving mode, therefore, by turning off the MOS transistor T1, the current flowing in the band gap bias circuit 11 and the MOS transistor 11 is reduced to zero, thus eliminating power consumption in the band gap bias circuit 11.

Figure 3:
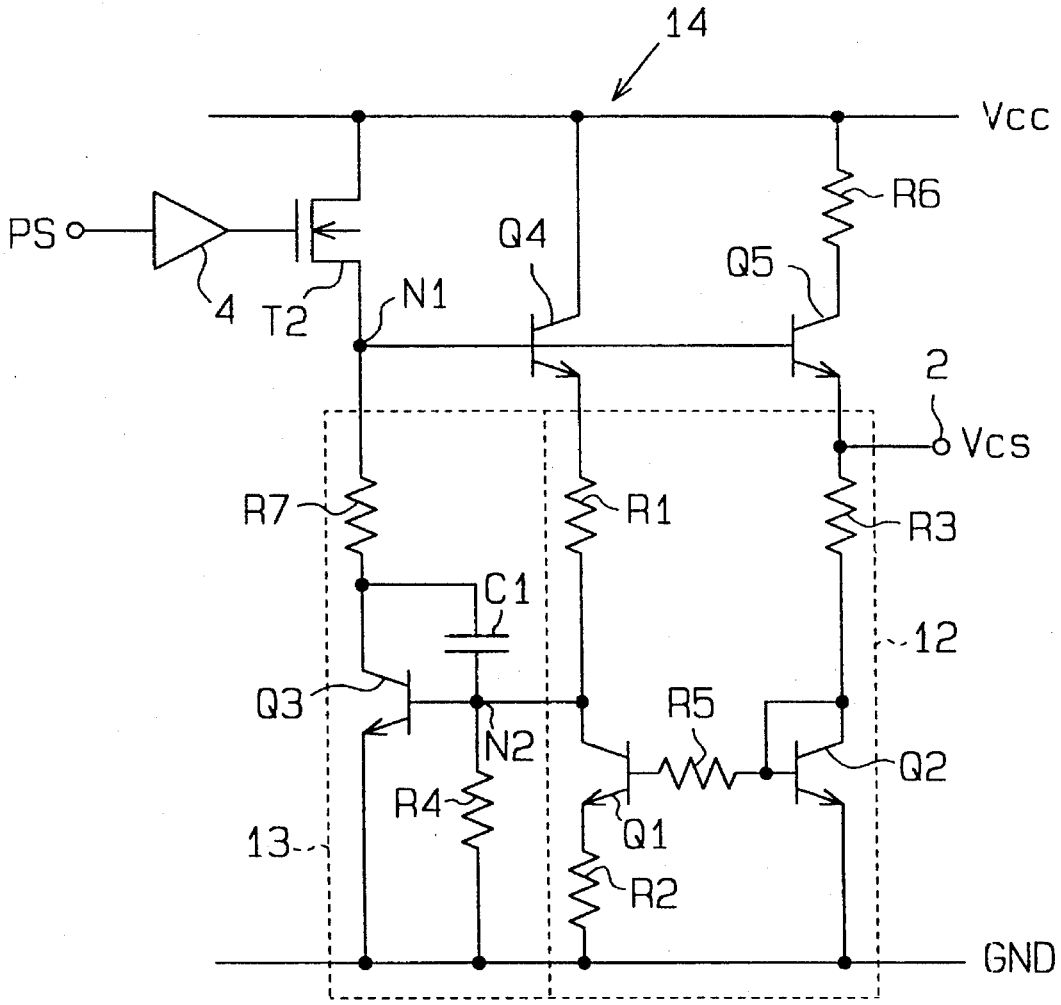
FIG. 3 is a circuit diagram showing another band gap bias circuit embodying the present invention.

FIG. 3 illustrates another band gap bias circuit 14 embodying this invention.

In the bias circuit 14, the P type MOS transistor T1 is replaced with an N type MOS transistor T2. A buffer 4 is connected to a gate of the MOS transistor T2. Circuit configuration except the above is the same as that shown in FIG. 2.

When the H-level control signal PS is inputted to this band gap bias circuit 14, therefore, the output of the buffer 4 becomes an H level and the MOS transistor T2 is turned on, rendering the band gap bias circuit 14 operable. With the band gap bias circuit in an operable state, the MOS transistor T2 serves as a resistor and constant voltage VCS is output from the output terminal 2 in the same manner as in the embodiment described above.

When the L-level control signal PS is inputted to the band gap bias circuit 14 when it is not necessary to output the voltage VCS, the output of the buffer 4 becomes an L level and the MOS transistor T2 is turned off, suppressing the bias voltage supplied to the bias circuit 14, causing the transistors Q1 through Q5 to turn off. This causes the band gap bias circuit 14 to be inactive. Therefore, the output voltage VCS from the output terminal 2 reaches the potential of the ground GND and the consumed power by the band gap bias circuit 14 is zero.

As described above, the resistor circuit, which supplies the bias voltage to the transistor Q4, Q5, is of the N type MOS transistor T2. Therefore, by turning off the MOS transistor T2, the current flowing in the band gap bias circuit 14 and the MOS transistor T2 can be reduced to zero, thus eliminating the power consumption by the bias circuit 14.

Figure 4:
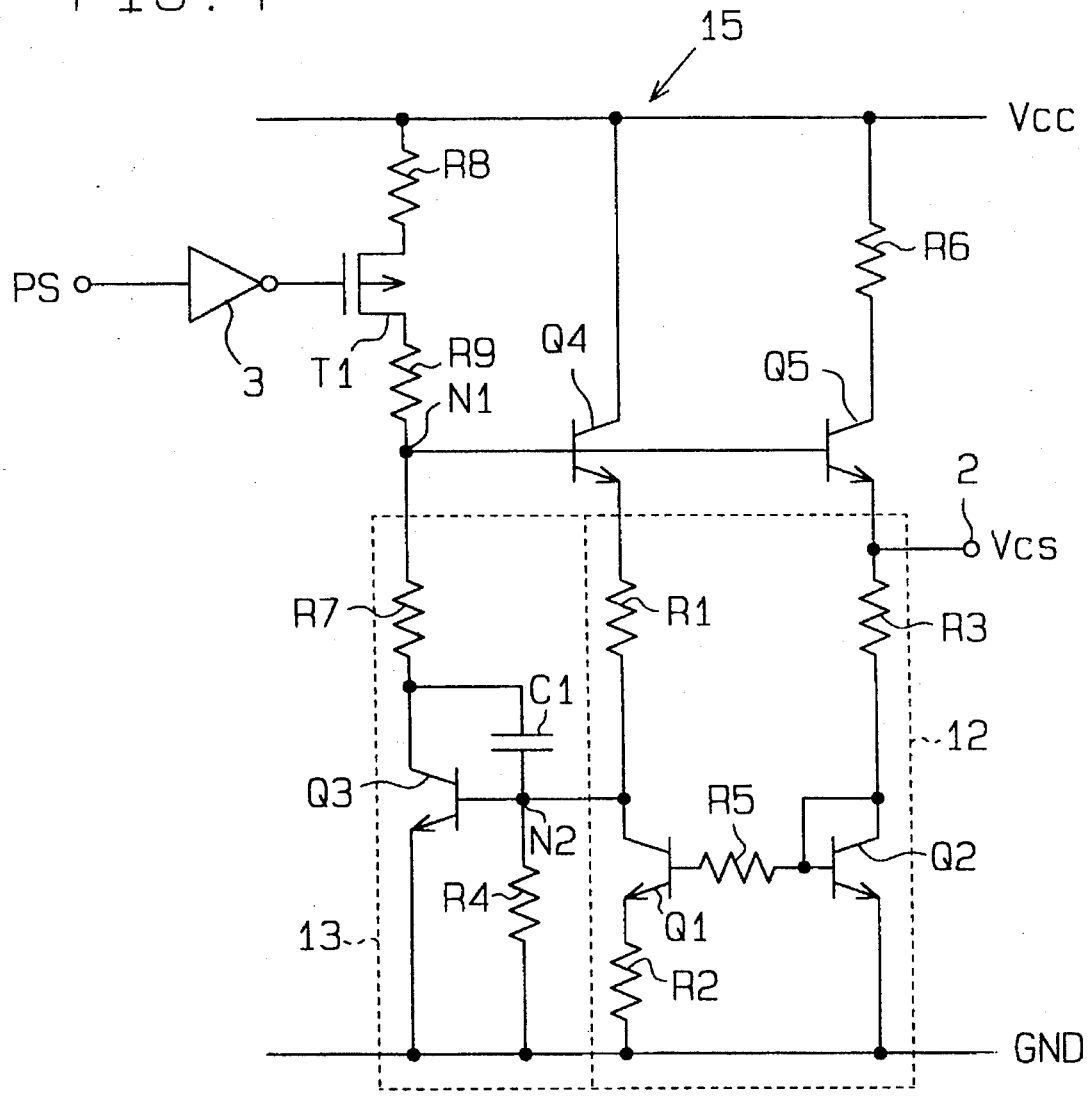
FIG. 4 is a circuit diagram showing yet another band gap bias circuit embodying the present invention.

FIG. 4 illustrates a different band gap bias circuit 15 embodying this invention. In this circuit 15, a resistor circuit between the node N1 and the power source VCC comprises the P type MOS transistor T1 and resistors R8, R9. The resistor R8 is connected between the source of the MOS transistor T1 and the power source VCC. The resistor R9 is connected between the drain of the MOS transistor T1 and the node N1. Circuit configuration except the above is the same as that in the embodiment shown in FIG. 2.

The bias circuit 15 in this embodiment has essentially the same function as that of the bias circuit 11 shown in FIG. 2.

It is beneficial to increase resistance in the resistor circuit. However, it is difficult to manufacture P type MOS transistors having a high on-state resistance, and also difficult to regulate the value of resistance accurately. On the other hand, the resistors R8, R9 are connected in series to the source and drain respectively of the MOS transistor T1 in the resistor circuit of the present embodiment. Therefore, if the resistors R8, R9 having high resistances are utilized, a P type MOS transistor T1 with low on-state resistance can be utilized. Such P type MOS transistors can easily be manufactured with current technology. And, even if the MOS transistors do deviate in various characteristics, because the on-state resistance is lower, the total deviation of the on-state resistance will be small. Accordingly, the operation of the bias circuit 15 is hardly influenced by the deviation, and the output voltage VCS from the bias circuit 15 can be kept constant. It is noted that any one of the resistors R8, R9 can be omitted from the bias circuit 15 in the present embodiment, without affecting circuit operation or deviating from the teachings of the invention.

Figure 5:
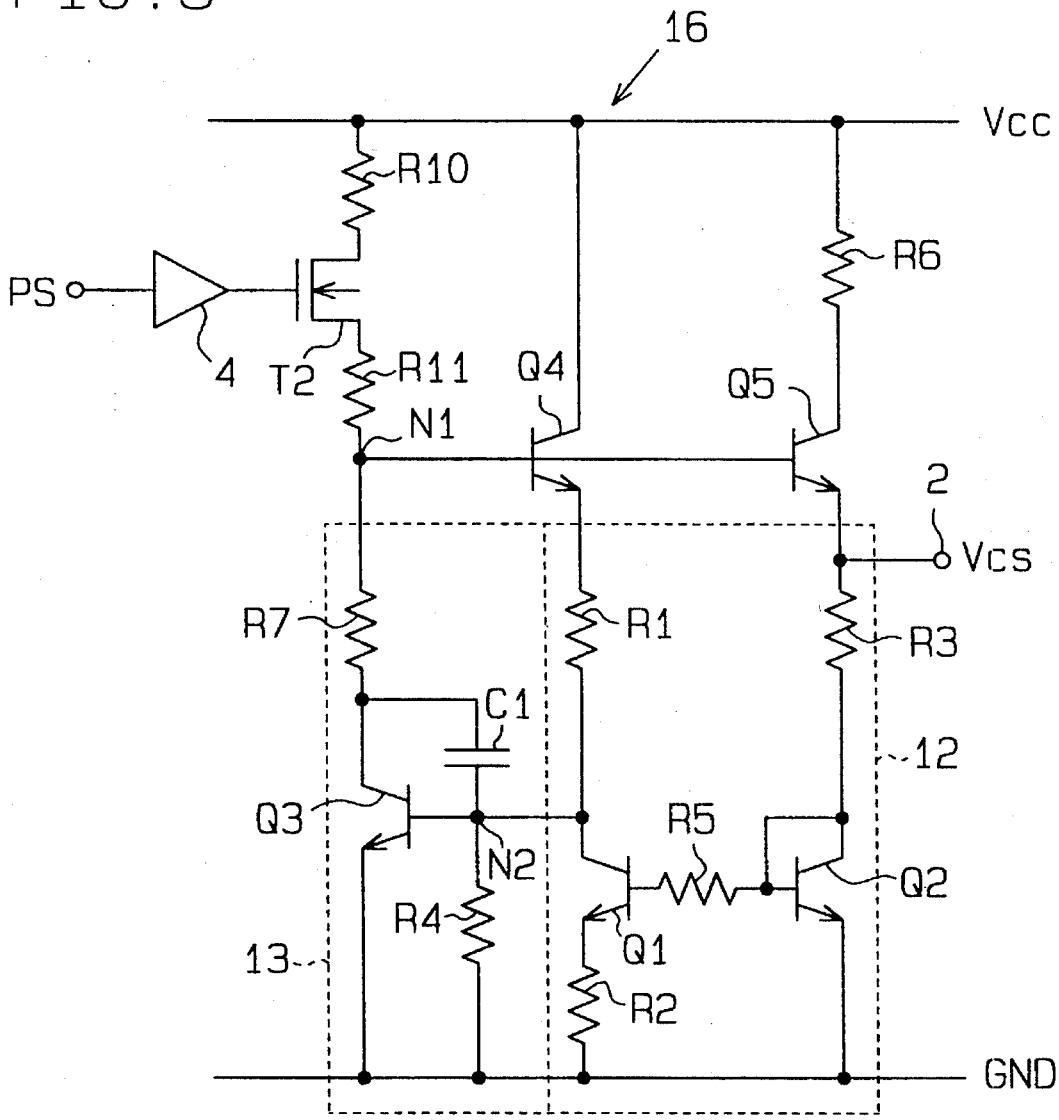
FIG. 5 is a circuit diagram showing a further band gap bias circuit embodying the present invention.

FIG. 5 shows a further different band gap bias circuit 16 embodying the present invention. A resistor circuit between the node N1 and the power source VCC in the circuit 16 comprises the N type MOS transistor T2 and resistors R10, R11. The resistor R10 is connected between the drain of the MOS transistor T2 and the power source VCC. The resistor R11 is connected between the source of the MOS transistor T2 and the node N1. Circuit configuration except the above is as noted same as the embodiment shown in FIG. 3. Accordingly, the bias circuit 16 in this embodiment has essentially the same function as that in the bias circuit 14 shown in FIG. 3.

It is also difficult to make N type MOS transistors having high on-state resistances and to regulate the resistances accurately, like the P type MOS transistors. In order to solve this disadvantage, the resistors R10, R11 are connected in series to the drain and source respectively of the N type transistor T2 like in the embodiment shown in FIG. 3. Therefore, the output voltage VCS from the bias circuit 16 in this embodiment can be kept constant. It is noted that any one of the resistors R10, R11 can also be omitted from the bias circuit 16 in the present embodiment.

Figure 6:
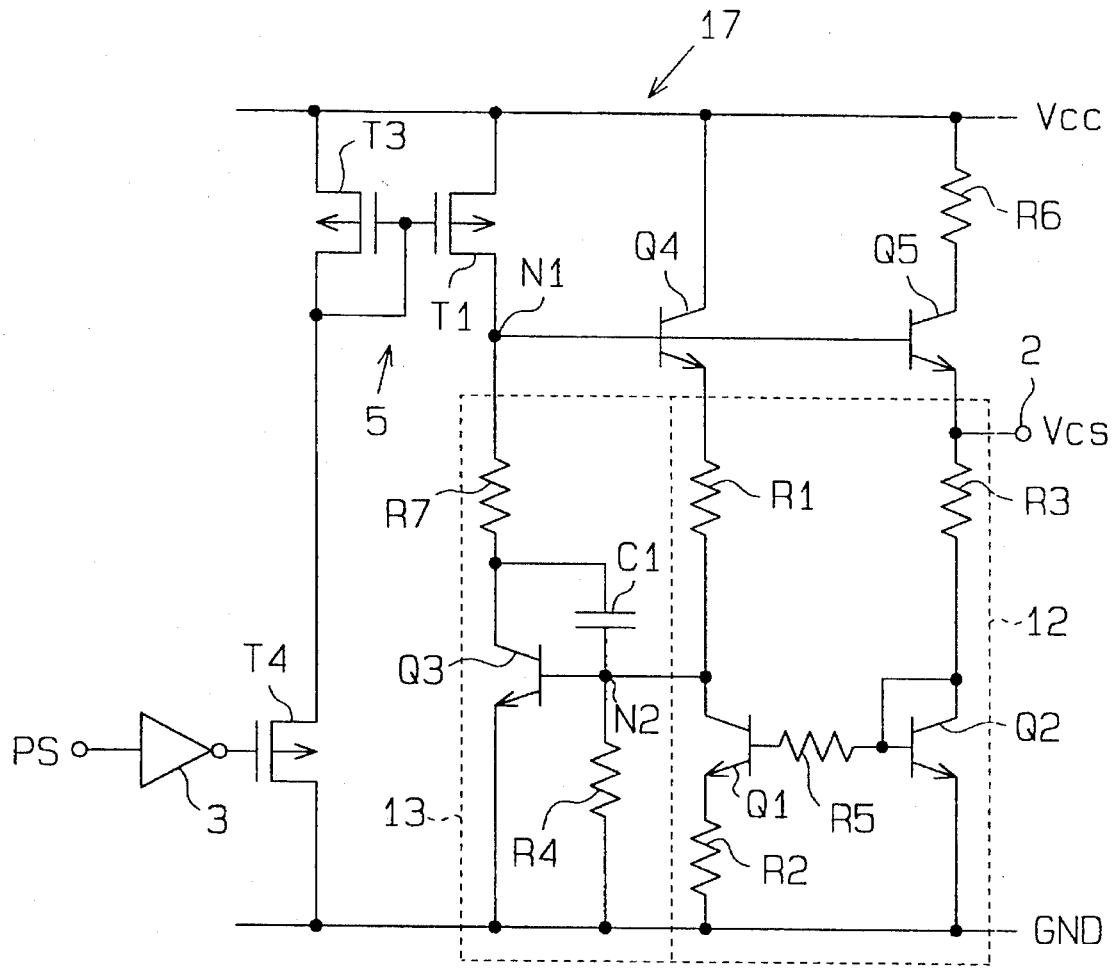
FIG. 6 is a circuit diagram showing a yet further band gap bias circuit embodying the present invention.

FIG. 6 illustrates a yet further band gap bias circuit 17 embodying the present invention wherein now P type MOS transistors T3 and T4 as second and third MOS transistors are additionally provided in the configuration of the bias circuit 11 shown in FIG. 2. The MOS transistor T3 has its source connected to the power source VCC and its gate and drain connected together. The gate of the MOS transistor T3 is connected to the gate of the MOS transistor T1. Both the MOS transistors T1, T3 constitute a current mirror circuit 5.

The MOS transistor T4 has its source connected to the drain of the PMOS transistor T3 and its drain connected to the ground GND. The gate of the PMOS transistor T4 is supplied with the control signal PS via the inverter 3.

When the H-level control signal PS is inputted to this band gap bias circuit, the output of the invertor 3 becomes an L level, turning on the PMOS transistor T4. As a result, the drain potential of the PMOS transistor T3 drops, activating the current mirror circuit 5 to supply a constant current to the PMOS transistor T1. This renders the band gap bias circuit 17 operable, so that a constant voltage VCS is output from terminal 2 in the same manner as does bias circuit 11 shown in FIG. 2.

The L-level control signal PS is inputted to the band gap bias circuit when it is not necessary to output the voltage VCS, whereupon the output of the inverter 3 becomes an H level, turning off the MOS transistor T4. The current mirror circuit 5 is therefore deactivated. As a result, the MOS transistor T1 is turned off, rendering the band gap bias circuit 17 inactive. When bias circuit 17 becomes inactive, the output voltage VCS is not output from the output terminal 2 (it is not needed), saving power consumption.

According to the bias circuit 17 in the present embodiment, the P type MOS transistor T1 as the resistor circuit and the PMOS transistor T3 constitute the current mirror circuit 5, and a P type MOS transistor T4 for turning on or off the current mirror circuit 5 is provided. Accordingly, besides having the same advantages as the first embodiment (bias circuit 11, FIG. 2), the band gap bias circuit 17 according to this embodiment can output a more stable constant voltage by allowing a constant current to flow through the P type MOS transistor T1 when the band gap bias circuit is active.

In addition, the P type MOS transistor T4 in the embodiment shown in FIG. 6 may be replaced with an N type MOS transistor, in which case the inverter 3 should be replaced with a buffer. Further, a resistor may be inserted between the drain of the P type MOS transistor T4 and the ground GND.

What is claimed is:

1. A constant voltage circuit connected between a high voltage power source and a low voltage power source for outputting a constant voltage signal from an output terminal thereof in response to a control signal inputted to an input terminal thereof, the constant voltage circuit comprising:

resistance circuit means including a first P type MOS transistor, a second P type MOS transistor connected to said first P type MOS transistor to form a current mirror circuit, and a third P type MOS transistor connected to said second P type MOS transistor, said first and second P type MOS transistors being activated when the control signal is inputted to a gate of said third P type MOS transistor to flow a constant current into said first P type MOS transistor;

a current mirror section connected between said resistance circuit means and the low voltage power source for generating an output voltage to be output from the output terminal; and a feedback section connected between said resistance circuit means and the low voltage power source for controlling said current mirror section to keep the output voltage constant by detecting deviation of the output voltage.

2. The constant voltage circuit according to claim 1, wherein said current mirror section includes:

first and second transistors each having a base, an emitter and a collector, the bases of said first and second transistors connected together;

first and second resistors connected to the collector side and the emitter side of said first transistor, respectively;

a third resistor having a first end connected to the collector of said second transistor and a second end connected to the output terminal; and wherein said feedback section includes a third transistor having a collector connected to said resistor circuit and a base connected to the collector of said first transistor, and a fourth resistor connected between the base and an emitter of said third transistor.

3. The constant voltage circuit according to claim 2, further including:

a fourth transistor having a collector connected to the high voltage power source, an emitter connected to said first resistor and a base connected to said resistance circuit means; and a fifth transistor having a collector connected to the high voltage power source, an emitter connected to said third resistor and a base connected to said resistance circuit means.

4. The constant voltage circuit according to claim 3, further comprising a resistor for connecting the bases of said first and second transistors with each other and a capacitor connected between the base and the collector of said third transistor.

5. A constant voltage circuit connected between a high voltage power source and a low voltage power source for outputting a constant voltage signal from an output terminal thereof in response to a control signal inputted to an input terminal thereof, the constant voltage circuit comprising:

resistance circuit means including a first P type MOS transistor connected to a second P type MOS transistor, and said second MOS transistor connected to a third MOS transistor, said first and second MOS transistors are activated when the control signal is inputted to a gate of said third MOS transistor to flow a constant current into said first MOS transistor;

a current mirror section including:

first and second transistors each having a base, an emitter and a collector, the bases of said first and second transistors being connected to each other;

first and second resistors connected to the collector and the emitter of said first transistor to form a circuit mirror circuit, respectively; and a third resistor having a first end connected to the collector of said second transistor and a second end connected to the output terminal; and a feedback section including:

a third transistor having a collector connected to said resistance circuit means and a base connected to the collector of said first transistor; and a fourth resistor connected between the base and an emitter of said third transistor.

6. The constant voltage circuit according to claim 5, further including:

a fourth transistor having a collector connected to the high voltage power source, an emitter connected to said first resistor and a base connected to said resistance circuit means; and a fifth transistor having a collector connected to the high voltage power source, an emitter connected to said third resistor and a base connected to said resistance circuit means.

7. A constant voltage circuit according to claim 6, further including a resistor for connecting the bases of said first and second transistors with each other and a capacitor connected between the base and the collector of said third transistor.

* * * * *